US006639168B1

(12) United States Patent
Castonguay et al.

(10) Patent No.: US 6,639,168 B1
(45) Date of Patent: Oct. 28, 2003

(54) ENERGY ABSORBING CONTACT ARM STOP

(75) Inventors: Roger N. Castonguay, Terryville, CT (US); Dean A. Robarge, Southington, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/655,647

(22) Filed: Sep. 6, 2000

Related U.S. Application Data

(60) Provisional application No. 60/190,179, filed on Mar. 17, 2000.

(51) Int. Cl.[7] ..... H01H 33/18

(52) U.S. Cl. ..... 218/22; 335/16; 335/46

(58) Field of Search ..... 335/23–25, 35–38, 335/42–46, 16, 147, 195, 167, 176; 218/22, 155

(56) References Cited

U.S. PATENT DOCUMENTS

| | | | |
|---|---|---|---|
| 2,340,682 A | | 2/1944 | Powell |
| 2,719,203 A | | 9/1955 | Gelzheiser et al. |
| 2,937,254 A | | 5/1960 | Ericson |
| 3,158,717 A | | 11/1964 | Jencks et al. |
| 3,162,739 A | | 12/1964 | Klein et al. |
| 3,197,582 A | | 7/1965 | Norden |
| 3,307,002 A | | 2/1967 | Cooper |
| 3,517,356 A | | 6/1970 | Hanafusa |
| 3,631,369 A | | 12/1971 | Menocal |
| 3,803,455 A | | 4/1974 | Willard |
| 3,883,781 A | | 5/1975 | Cotton |
| 4,129,762 A | | 12/1978 | Bruchet |
| 4,144,513 A | | 3/1979 | Shafer et al. |
| 4,158,119 A | | 6/1979 | Krakik |
| 4,165,453 A | | 8/1979 | Hennemann |
| 4,166,988 A | | 9/1979 | Ciarcia et al. |
| 4,220,934 A | | 9/1980 | Wafer et al. |
| 4,255,732 A | * | 3/1981 | Wafer et al. ..... 335/16 |
| 4,259,651 A | | 3/1981 | Yamat |

(List continued on next page.)

FOREIGN PATENT DOCUMENTS

| | | |
|---|---|---|
| BE | 819 008 A | 12/1974 |
| BE | 38 02 184 | 8/1989 |
| DE | 12 27 978 | 11/1966 |
| DE | 30 47 360 | 6/1982 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |

(List continued on next page.)

*Primary Examiner*—Tuyen T. Nguyen
(74) *Attorney, Agent, or Firm*—Cantor Colburn LLP

(57) ABSTRACT

A circuit breaker cassette comprises a housing having a fixed contact, and a movable contact on a contact arm. The contact arm is positionable in a closed position and an open position, wherein the contact arm is closed when the movable contact is in contact with said fixed contact. A spring biases the movable contact arm towards the closed position A kinetic energy-absorbing stop is positioned to absorb kinetic energy of the contact arm resulting from magnetic repulsive forces forcing the movable contact and the fixed contact apart during a short circuit condition.

12 Claims, 5 Drawing Sheets

U.S. PATENT DOCUMENTS

| | | | | |
|---|---|---|---|---|
| 4,263,492 | A | | 4/1981 | Maier et al. |
| 4,276,527 | A | | 6/1981 | Gerbert-Gaillard et al. |
| 4,297,663 | A | | 10/1981 | Seymour et al. |
| 4,301,342 | A | | 11/1981 | Castonguay et al. |
| 4,360,852 | A | | 11/1982 | Gilmore |
| 4,368,444 | A | | 1/1983 | Preuss et al. |
| 4,375,021 | A | | 2/1983 | Pardini et al. |
| 4,375,022 | A | | 2/1983 | Daussin et al. |
| 4,376,270 | A | | 3/1983 | Staffen |
| 4,383,146 | A | | 5/1983 | Bur |
| 4,392,036 | A | | 7/1983 | Troebel et al. |
| 4,393,283 | A | | 7/1983 | Masuda |
| 4,401,872 | A | | 8/1983 | Boichot-Castagne et al. |
| 4,409,573 | A | | 10/1983 | Di Marco et al. |
| 4,435,690 | A | | 3/1984 | Link et al. |
| 4,467,297 | A | | 8/1984 | Boichot-Castagne et al. |
| 4,468,645 | A | | 8/1984 | Gerbert-Gaillard et al. |
| 4,470,027 | A | | 9/1984 | Link et al. |
| 4,479,143 | A | | 10/1984 | Watanabe et al. |
| 4,488,133 | A | | 12/1984 | McClellan et al. |
| 4,492,941 | A | | 1/1985 | Nagel |
| 4,541,032 | A | | 9/1985 | Schwab |
| 4,546,224 | A | | 10/1985 | Mostosi |
| 4,550,360 | A | | 10/1985 | Dougherty |
| 4,562,419 | A | | 12/1985 | Preuss et al. |
| 4,589,052 | A | | 5/1986 | Dougherty |
| 4,595,812 | A | | 6/1986 | Tamaru et al. |
| 4,611,187 | A | | 9/1986 | Banfi |
| 4,612,430 | A | | 9/1986 | Sloan et al. |
| 4,616,198 | A | | 10/1986 | Pardini |
| 4,622,444 | A | | 11/1986 | Kandatsu et al. |
| 4,631,625 | A | | 12/1986 | Alexander et al. |
| 4,642,431 | A | | 2/1987 | Tedesco et al. |
| 4,644,438 | A | | 2/1987 | Puccinelli et al. |
| 4,649,247 | A | | 3/1987 | Preuss et al. |
| 4,658,322 | A | | 4/1987 | Rivera |
| 4,672,501 | A | | 6/1987 | Bilac et al. |
| 4,675,481 | A | | 6/1987 | Markowski et al. |
| 4,682,264 | A | | 7/1987 | Demeyer |
| 4,689,712 | A | | 8/1987 | Demeyer |
| 4,694,373 | A | | 9/1987 | Demeyer |
| 4,710,845 | A | | 12/1987 | Demeyer |
| 4,717,985 | A | | 1/1988 | Demeyer |
| 4,733,211 | A | | 3/1988 | Castonguay et al. |
| 4,733,321 | A | | 3/1988 | Lindeperg |
| 4,764,650 | A | | 8/1988 | Bur et al. |
| 4,768,007 | A | | 8/1988 | Mertz et al. |
| 4,780,786 | A | | 10/1988 | Weynachter et al. |
| 4,831,221 | A | | 5/1989 | Yu et al. |
| 4,870,531 | A | | 9/1989 | Danek |
| 4,883,931 | A | | 11/1989 | Batteux et al. |
| 4,884,047 | A | | 11/1989 | Baginski et al. |
| 4,900,882 | A | | 2/1990 | Bernard et al. |
| 4,910,485 | A | | 3/1990 | Bolongeat-Mobleu et al. |
| 4,914,541 | A | | 4/1990 | Tripodi et al. |
| 4,916,420 | A | | 4/1990 | Bartolo et al. |
| 4,916,421 | A | * | 4/1990 | Pardini et al. ..... 335/185 |
| 4,926,282 | A | | 5/1990 | McGhie |
| 4,935,590 | A | | 6/1990 | Malkin et al. |
| 4,937,706 | A | | 6/1990 | Schueller et al. |
| 4,939,492 | A | | 7/1990 | Raso et al. |
| 4,943,691 | A | | 7/1990 | Mertz et al. |
| 4,943,888 | A | | 7/1990 | Jacob et al. |
| 4,950,855 | A | | 8/1990 | Bolonegeat-Mobleu et al. |
| 4,951,019 | A | | 8/1990 | Gula |
| 4,952,897 | A | | 8/1990 | Barnel et al. |
| 4,958,135 | A | | 9/1990 | Baginski et al. |
| 4,963,849 | A | | 10/1990 | Kowalczyk et al. |
| 4,965,543 | A | | 10/1990 | Batteux |
| 4,983,788 | A | | 1/1991 | Pardini |
| 5,001,313 | A | | 3/1991 | Leclerq et al. |
| 5,004,878 | A | | 4/1991 | Seymour et al. |
| 5,029,301 | A | | 7/1991 | Nebon et al. |
| 5,030,804 | A | | 7/1991 | Abri |
| 5,049,846 | A | * | 9/1991 | Morgan et al. ..... 335/202 |
| 5,057,655 | A | | 10/1991 | Kersusan et al. |
| 5,077,627 | A | | 12/1991 | Fraisse |
| 5,083,081 | A | | 1/1992 | Barrault et al. |
| 5,095,183 | A | | 3/1992 | Raphard et al. |
| 5,103,198 | A | | 4/1992 | Morel et al. |
| 5,115,371 | A | | 5/1992 | Tripodi |
| 5,120,921 | A | | 6/1992 | DiMarco et al. |
| 5,132,865 | A | | 7/1992 | Mertz et al. |
| 5,138,121 | A | | 8/1992 | Streich et al. |
| 5,140,115 | A | | 8/1992 | Morris |
| 5,153,802 | A | | 10/1992 | Mertz et al. |
| 5,155,315 | A | | 10/1992 | Malkin et al. |
| 5,166,483 | A | | 11/1992 | Kersusan et al. |
| 5,172,087 | A | | 12/1992 | Castonguay et al. |
| 5,178,504 | A | | 1/1993 | Falchi |
| 5,184,717 | A | | 2/1993 | Chou et al. |
| 5,187,339 | A | | 2/1993 | Lissandrin |
| 5,198,956 | A | | 3/1993 | Dvorak |
| 5,200,724 | A | | 4/1993 | Gula et al. |
| 5,210,385 | A | | 5/1993 | Morel et al. |
| 5,239,150 | A | | 8/1993 | Bolongeat-Mobleu et al. |
| 5,258,733 | A | * | 11/1993 | Link et al. ..... 335/172 |
| 5,260,533 | A | | 11/1993 | Livesey et al. |
| 5,262,744 | A | | 11/1993 | Arnold et al. |
| 5,280,144 | A | | 1/1994 | Bolongeat-Mobleu et al. |
| 5,281,776 | A | | 1/1994 | Morel et al. |
| 5,296,660 | A | | 3/1994 | Morel et al. |
| 5,296,664 | A | | 3/1994 | Crookston et al. |
| 5,298,874 | A | | 3/1994 | Morel et al. |
| 5,300,907 | A | | 4/1994 | Nereau et al. |
| 5,310,971 | A | * | 5/1994 | Vial et al. ..... 335/16 |
| 5,313,180 | A | * | 5/1994 | Vial et al. ..... 335/16 |
| 5,317,471 | A | | 5/1994 | Izoard et al. |
| 5,331,500 | A | | 7/1994 | Corcoles et al. |
| 5,334,808 | A | | 8/1994 | Bur et al. |
| 5,341,191 | A | | 8/1994 | Crookston et al. |
| 5,347,096 | A | | 9/1994 | Bolongeat-Mobleu et al. |
| 5,347,097 | A | | 9/1994 | Bolongeat-Mobleu et al. |
| 5,350,892 | A | | 9/1994 | Rozier |
| 5,357,066 | A | | 10/1994 | Morel et al. |
| 5,357,068 | A | | 10/1994 | Rozier |
| 5,357,394 | A | | 10/1994 | Piney |
| 5,361,052 | A | | 11/1994 | Ferullo et al. |
| 5,373,130 | A | | 12/1994 | Barrault et al. |
| 5,379,013 | A | | 1/1995 | Coudert |
| 5,424,701 | A | | 6/1995 | Castonguay et al. |
| 5,438,176 | A | | 8/1995 | Bonnardel et al. |
| 5,440,088 | A | | 8/1995 | Coudert et al. |
| 5,449,871 | A | | 9/1995 | Batteux et al. |
| 5,450,048 | A | | 9/1995 | Leger et al. |
| 5,451,729 | A | | 9/1995 | Onderka et al. |
| 5,457,295 | A | | 10/1995 | Tanibe et al. |
| 5,467,069 | A | | 11/1995 | Payet-Burin et al. |
| 5,469,121 | A | | 11/1995 | Payet-Burin |
| 5,475,558 | A | | 12/1995 | Barjonnet et al. |
| 5,477,016 | A | | 12/1995 | Baginski et al. |
| 5,479,143 | A | | 12/1995 | Payet-Burin |
| 5,483,212 | A | | 1/1996 | Lankuttis et al. |
| 5,485,343 | A | | 1/1996 | Santos et al. |
| D367,265 | S | | 2/1996 | Yamagata et al. |
| 5,493,083 | A | | 2/1996 | Olivier |
| 5,504,284 | A | | 4/1996 | Lazareth et al. |
| 5,504,290 | A | | 4/1996 | Baginski et al. |
| 5,510,761 | A | | 4/1996 | Boder et al. |
| 5,512,720 | A | | 4/1996 | Coudert et al. |
| 5,515,018 | A | | 5/1996 | DiMarco et al. |

| | | | | |
|---|---|---|---|---|
| 5,519,561 | A | | 5/1996 | Mrenna et al. |
| 5,534,674 | A | | 7/1996 | Steffens |
| 5,534,832 | A | * | 7/1996 | Duchemin et al. ..... 335/16 |
| 5,534,835 | A | | 7/1996 | McColloch et al. |
| 5,534,840 | A | | 7/1996 | Cuingnet |
| 5,539,168 | A | | 7/1996 | Linzenich |
| 5,543,595 | A | | 8/1996 | Mader et al. |
| 5,552,755 | A | | 9/1996 | Fello et al. |
| 5,581,219 | A | | 12/1996 | Nozawa et al. |
| 5,604,656 | A | | 2/1997 | Derrick et al. |
| 5,608,367 | A | | 3/1997 | Zoller et al. |
| 5,784,233 | A | | 7/1998 | Bastard et al. |

FOREIGN PATENT DOCUMENTS

| | | |
|---|---|---|
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555 158 | 8/1993 |
| EP | 0 560 697 | 9/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2033159 | 5/1980 |
| GB | 2 233 155 | 1/1991 |
| WO | 92/00598 | 1/1992 |
| WO | 92/05649 | 4/1992 |
| WO | 96/00901 | 1/1994 |

* cited by examiner

ENERGY ABSORBING CONTACT ARM STOP

CROSS REFERENCE TO RELATED APPLICATIONS

This application claims benefit of earlier-filed U.S. Provisional Application No. 60/190,179, filed Mar. 17, 2000, which is fully incorporated herein by reference.

BACKGROUND OF THE INVENTION

This invention relates to circuit breakers, and, more particularly, to a movable contact arm stop that provides a resilient bumper to absorb the opening energy of a movable contact arm.

In typical circuit breakers, one or more springs are employed for maintaining a contact between movable contacts and fixed contacts against magnetic repulsive forces that naturally build up between the contacts. During short circuit occurrences, magnetic repulsive forces are sufficient to accelerate the movable contact arm of a rotary contact assembly at a very high rate of speed. Contact made between the highly accelerated movable contact arm and surfaces on the inside of the rotary contact assembly may cause the movable contact arm to rebound, which can be undesirable.

Prior art designs attempt to reduce the opening energy by slowing down the speed at which the movable contact arm opens. Prior art designs also incorporate catchers and locks to retain the movable contact arms in the open positions. However, such mechanisms are complicated and expensive, and are not completely reliable.

BRIEF SUMMARY OF THE INVENTION

To overcome the above discussed and other disadvantages of the prior art, the present invention provides a circuit breaker cassette comprising a housing having a fixed contact mounted within the housing, and a movable contact mounted on a contact arm. The contact arm is positionable in a closed position and an open position, wherein the contact arm is closed when the movable contact is in contact with said fixed contact. A spring biases the movable contact arm towards the closed position. A kinetic energy-absorbing stop is positioned to absorb kinetic energy of the contact arm resulting from magnetic repulsive forces forcing the movable contact and the fixed contact apart during a short circuit condition. The kinetic energy-absorbing stop comprises a material more resilient than material forming said housing.

The above discussed and other features and advantages of the present invention will be appreciated and understood by those skilled in the art from the following detailed description and drawings.

BRIEF DESCRIPTION OF THE DRAWINGS

Referring to the exemplary drawings wherein like elements are numbered alike in the several FIGURES.

DETAILED DESCRIPTION OF THE INVENTION

Figure 1:
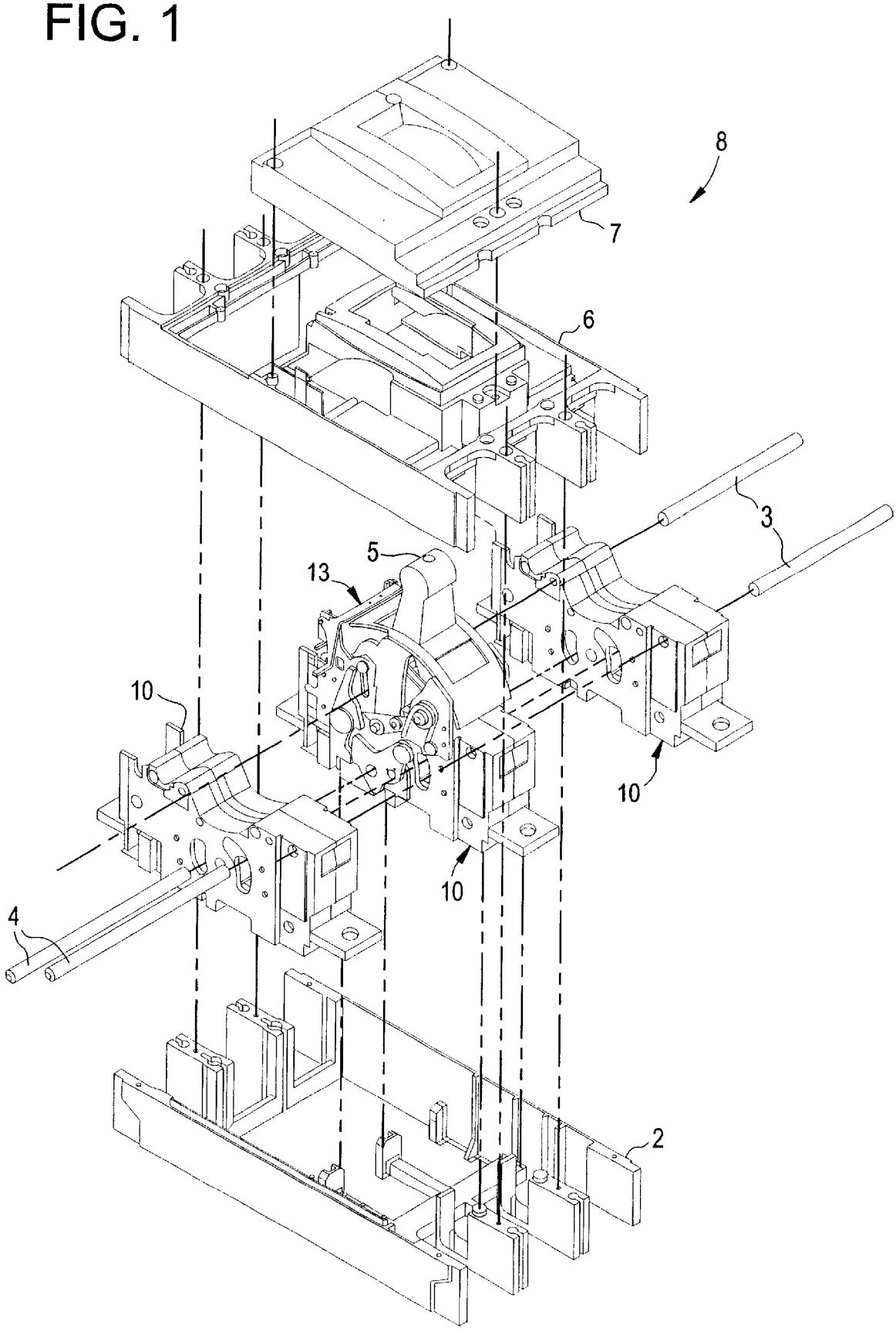
FIG. 1 shows an exploded view of a circuit breaker of the invention.

FIG. 1 shows an exploded view of molded-case circuit breaker 8. Although a molded case circuit breaker is shown, the invention is applicable to other circuit breakers types. Circuit breaker 8 comprises a case 2 holding three breaker cassettes 10. Each breaker cassette 10 operates to brake the current in one pole of the power circuit controlled by circuit breaker 8. Rods 3 tie cassettes 10 together into a unit and rods 4 mechanically link an operating mechanism 13 to cassettes 10 so that the contacts in all three cassettes 10 open and close in unison when operating mechanism 13 is tripped.

Operating mechanism 13 sits atop the center cassette 10 and includes handle 5 for manual operation of circuit breaker 8. A mid-cover 6 encloses cassettes 10 and includes an aperture allowing access to handle 5. Top-cover 7 protects accessories, trip units, and other components (not shown) that may be added to circuit breaker 8.

Figure 2:
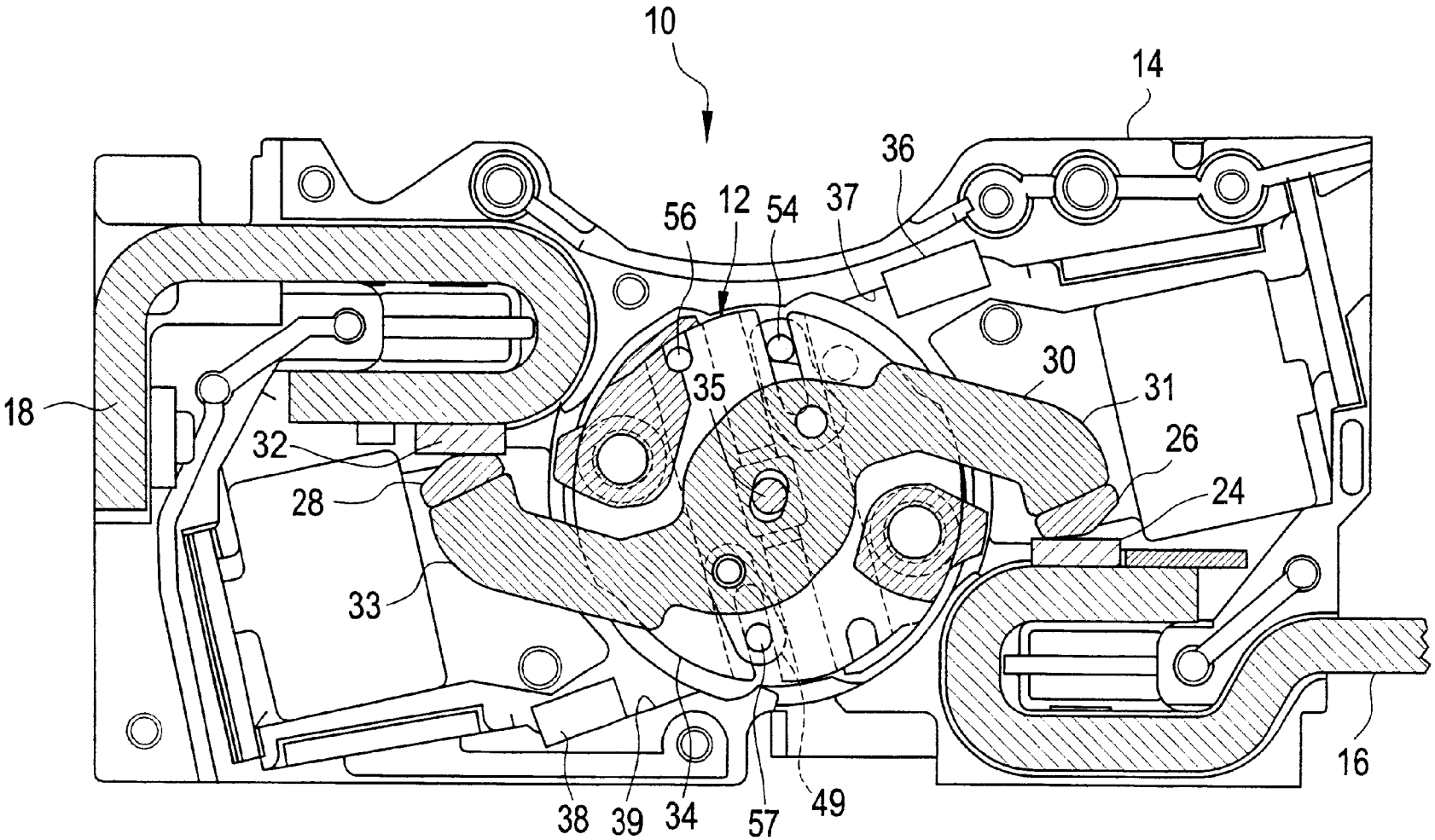
FIG. 2 and FIG. 3 show a plan of a circuit breaker cassette of the invention with part of its housing removed.

Referring to FIG. 2, a circuit breaker cassette 10 is shown with one cover removed to reveal aspects of the inner structure of cassette 10. Cassette 10 comprises a rotary contact assembly, shown generally at 12, in an electrically-insulated housing 14 intermediate a line-side contact strap 16, and a load-side contact strap 18. Line-side contact strap 16 is electrically connectable to line-side wiring (not shown) in an electrical distribution circuit, and load-side contact strap 18 is electrically connectable to load-side wiring (not shown) via a lug (not shown) or a device such as a bimetallic element or current sensor (not shown). As mentioned with regard to FIG. 1, a separate cassette 10 is employed for each pole of multi-pole molded-case circuit breaker 8.

Electricity travels through rotary contact assembly 12 of cassette 10 from line-side contact strap 16 to an associated fixed contact 24, through movable contacts 26, 28 secured to the ends of a movable contact arm shown generally at 30, and to an associated fixed contact 32 on load-side contact strap 18. Movable contact arm 30 is pivotally arranged between two halves of a rotor 34 and moves in conjunction with rotor 34 upon rotation of rotor 34 by operating mechanism 13 (FIG. 1). Rotor 34 is rotatably positioned on a rotor pivot axle 35, the ends of which are supported by inner parallel walls of electrically-insulated housing 14. When movable contact arm 30 is positioned such that movable contact 26 is in intimate contact with fixed contact 24 and such that movable contact 28 is in intimate contact with fixed contact 32, rotary contact assembly 12 is said to be in the "closed" position.

It should be noted that although a contact arm 30 is shown having two movable contacts 26 and 28 on distal ends 31 and 33 of contact arm 30, respectively, it is also possible to have a contact arm with only one distal portion and only one movable contact. In this case, the electrical connection continues from one of the contact straps, through a fixed contact to a movable contact on the contact arm, then through the contact arm and then a braided conductor connecting the contact arm to the other contact strap.

The inventive kinetic energy-absorbing stops 36, 38 are mounted within electrically-insulated housing 14 and are positioned to be engaged by movable contact arm 30 in the event that contact arm 30 is forced into an "open" position by magnetic forces generated during a short circuit condition. Energy-absorbing contact arm stops 36, 38 are fabricated of a material of sufficient resiliency to cushion movable contact arm 30 and absorb kinetic energy of the contact arm resulting from the rapid opening of movable contact arm 30. A medium-grade closed-cell resilient polyurethane foam is contemplated for use in this application.

Figure 3:
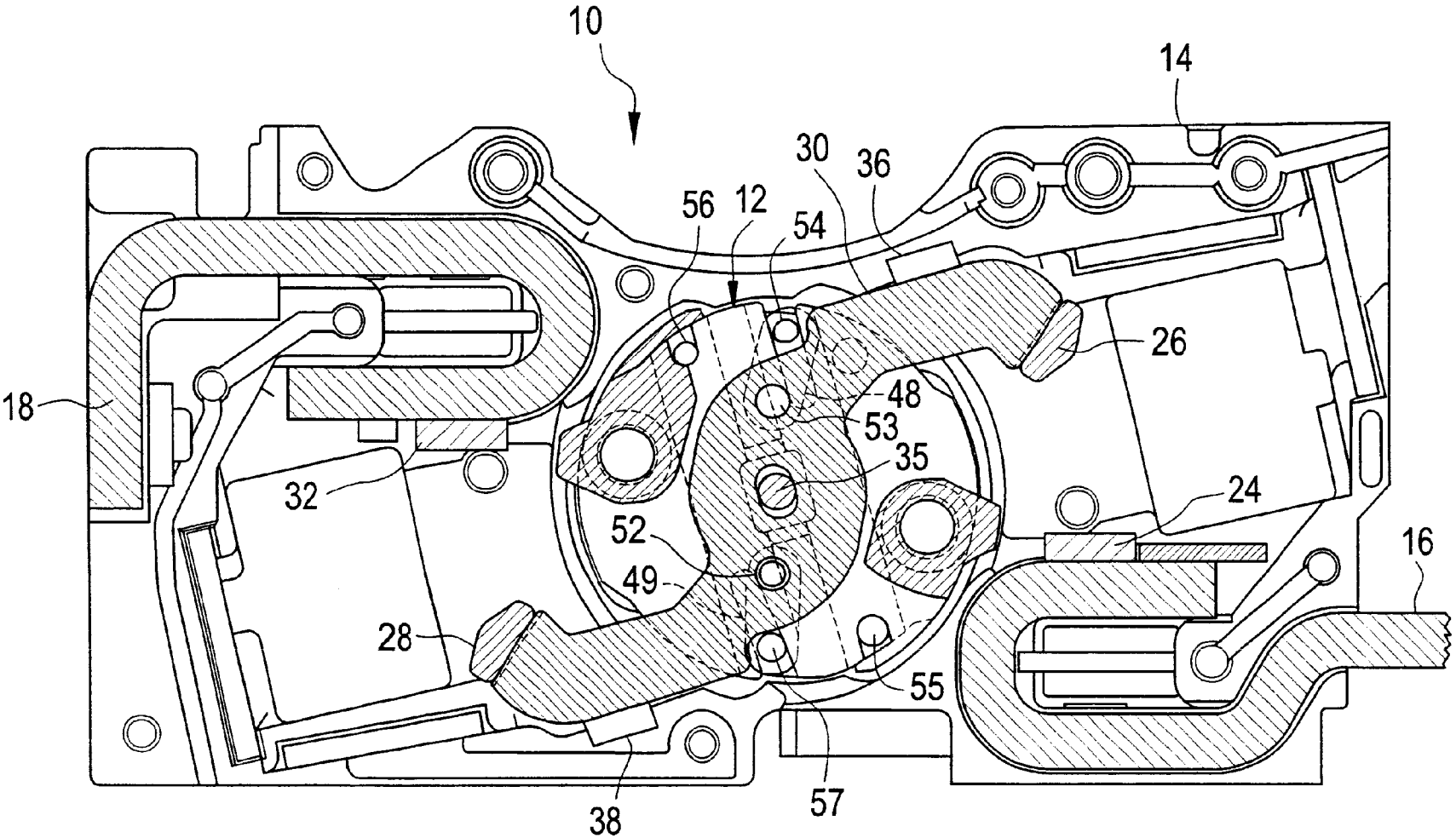
Figure 4:
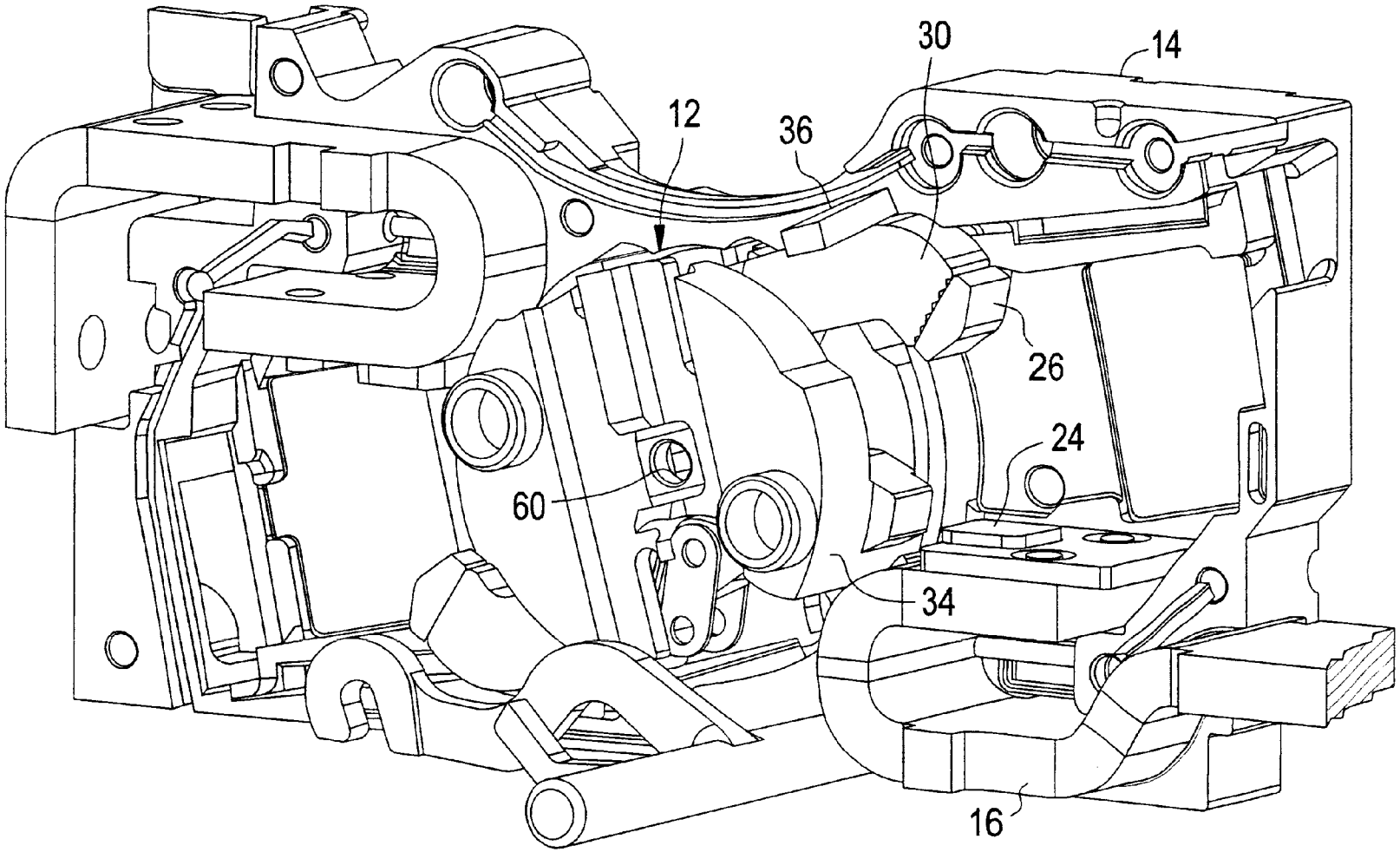
FIG. 4 shows a perspective view of the circuit breaker cassette shown in FIGS. 2 and 3.

FIGS. 3 and 4 show rotary contact assembly 12 with movable contact arm 30 in an "open" position as a result of an encountered overcurrent condition. Because of the overcurrent condition, movable contact arm 30 is forced into the "open" position by magnetic repulsive forces generated between pairs 24, 26 and 28,32 of fixed and movable contacts during a short circuit condition. In opening the circuit, the magnetic repulsive forces act against the forces created by the contact springs 40, 41, 58, and 59 (FIG. 5), which tend to maintain contact arm 30 in a closed position. However, when the contact arm 30 is forced into the open position by magnetic forces, pivots 52 and 53, shown in FIGS. 3 and 5, and discussed in more detail below, are rotated around rotor pivot axle 35 positioning links 48 and 49 such that the torque applied by springs 40, 41, 58 and 59 is now in the counter-clockwise direction, biasing contact arm 30 in the open position shown in FIG. 3.

The mounting of energy-absorbing contact arm stops 36, 38 on inner surfaces 37, 39 cushions the contact made thereon when movable contact arm 30 is forced open. The resiliency of energy-absorbing contact arm stops 36, 38 then dissipates the energy generated by the force of the contact, reducing the likelihood that contact arm 30 would rebound to the closed position.

Figure 5:
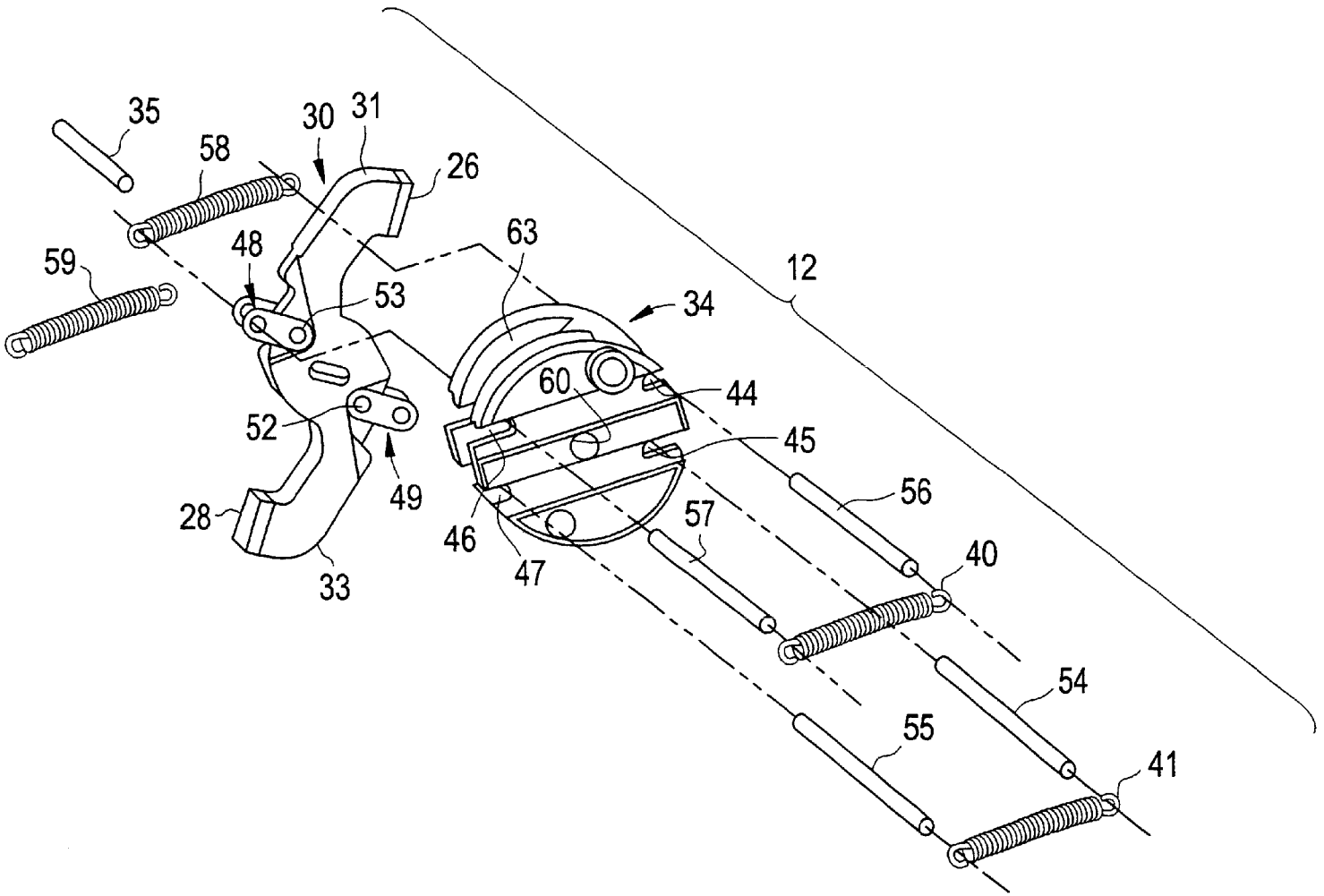
FIG. 5 shows an exploded view of a rotor and contact arm assembly.

Referring especially to FIG. 5, rotary contact assembly 12 will now be more fully described. Contact arm 30 slides in opening 63 in rotor 34 and pivot axle 35 slides through both the elongated aperture in contact arm 30 and the apertures 59 in rotor 34, thereby allowing contact arm 30 to pivot about axle 35 independently of rotor 34. A first contact spring 40 is stretched across the face of rotor 34. First contact spring 40 is supported on one end by a first spring pin 56, which rests in slot 44. First contact spring 40 is supported on a second end by a second spring pin 57, which rests in slot 46. A second contact spring 41 is likewise supported on the same face of rotor 34 and is positioned to extend parallel to the first contact spring between pins 54 and 55 which in turn rest in slots 45 and 47, respectively. A third contact spring 58 is positioned on the opposing face of rotor 34 opposite spring 40, and is supported by spring pin 56. A fourth contact spring 59 is supported on the opposing face of rotor 34 parallel to the third contact spring and opposite spring 41, extending between pins 54 and 55. Pins 56 and 55 are pulled by springs 40 and 41 to the bottom of slots 44 and 47, respectively. Pins 57 and 54 pass through slots 46 and 45, and .through links 48 and 49, respectively. The contact springs are thus connected to both rotor 34 and contact arm 30 in such a manner so as to bias contact arm 30 into a closed position relative to rotor 34, thereby ensuring an electrically sound connection between fixed contacts 24, 32 (see FIGS. 1–3) and movable contacts 26, 28.

While this invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit breaker cassette comprising:

a housing with an inner surface;

at least two fixed contacts within said housing;

a movable contact assembly disposed within said housing, said movable contact assembly comprising at least two movable contacts on a contact arm, said contact arm being positionable in a closed position and a blown open position wherein said contact arm is closed when said at least two movable contacts are in contact with said at least two fixed contacts and said contact arm is blown open when said at least two movable contacts are repelled away from said at least two fixed contacts in response to a short circuit condition;

said movable contact assembly further comprising at least one contact spring, said at least one contact spring having an orientation that exerts a closing bias torque on said contact arm relative to said at least two fixed contacts when said contact arm is closed, said closing bias torque not increasing from a closed position to a blown open position of said movable contact arm; and at least one kinetic energy-absorbing stop disposed proximate to said inner surface, wherein a surface of said contact arm, said inner surface, and a surface of said at least one kinetic energy-absorbing stop are generally parallel to each other when said contact arm is in said blown open position, wherein said at least one kinetic energy-absorbing stop comprising a material that absorbs and dissipates the kinetic energy resulting from magnetic repulsive forces forcing said at least two movable contacts and said at least two fixed contacts apart during a short circuit condition so that said contact arm does not rebound to the closed position.

2. The circuit breaker cassette of claim 1 wherein:

said at least one kinetic energy-absorbing stop is formed from closed-cell polyurethane foam.

3. The circuit breaker cassette of claim 1 wherein:

said movable contact assembly further comprises a rotor rotably mounted within said housing;

said rotor and said contact arm pivot on a common axis.

4. The circuit breaker cassette of claim 1 wherein:

said contact arm comprises a first distal end and a second distal end;

said at least two movable contacts being disposed one on said first distal end and another on said second distal end;

said at least one kinetic energy absorbing stop comprising two kinetic energy absorbing stops each being positioned to absorb kinetic energy of said first and second distal ends of said contact arm, respectively.

5. A circuit breaker comprising:

a housing;

a cassette disposed within said housing, said cassette includes an inner surface;

at least two fixed contacts disposed within said cassette;

a rotar movable contact assembly disposed within said cassette, said movable contact assembly comprising at least two movable contacts on a contact arm, said contact arm being positionable in a closed position and a blown open position, wherein said contact arm is closed when said at least two movable contacts are in contact with said at least two fixed contacts and said contact arm is blown open when said at least two movable contacts are repelled away from said at least two fixed contacts in response to a short circuit condition;

said movable contact assembly further comprising at least one contact spring, said at least one contact spring having an orientation that exerts a closing bias torque on said contact arm relative to said at least two fixed contacts when said contact arm is closed, said closing bias torque not increasing from a closed position to a blown open position of said movable contact arm; and at least one kinetic energy-absorbing stop disposed proximate to said inner surface, wherein a surface of said contact arm, said inner surface, and a surface of said at least one kinetic energy-absorbing stop are generally parallel to each other when said contact arm is in said blown open position, wherein said at least one kinetic energy-absorbing stop absorbs and dissipates the kinetic energy resulting from magnetic repulsive forces forcing said at least two movable contacts and said at least two fixed contacts apart during a short circuit condition so that said contact arm does not rebound to the closed position.

6. The circuit breaker of claim 5 wherein:

said at least one kinetic energy-absorbing stop is formed from closed-cell polyurethane foam.

7. The circuit breaker of claim 5 wherein:

said movable contact assembly further comprises a rotor rotably mounted within said housing;

said rotor and said contact arm pivot on a common axis.

8. The circuit breaker of claim 5 wherein:

said contact arm comprises a first distal end and a second distal end;

said at least one two movable contacts being disposed one on said first distal end and another on said second distal end.

9. The circuit breaker of claim 8 further comprising:

said at least one kinetic energy-absorbing stop comprising two and said second kinetic energy-absorbing stops each being positioned to absorb a kinetic energy of said first and second distal ends of said contact arm, respectively.

10. A circuit breaker comprising:

a housing;

a cassette disposed within said housing, said cassette includes an inner surface;

a first fixed contact disposed within said cassette;

a second fixed contact disposed within said cassette;

a movable contact assembly disposed within said cassette, said movable contact assembly comprising; at least two movable contacts on a contact arm, at least one contact springs that positions at least one spring support member and exerts a closing bias torque on said contact arm when said contact arms is closed, said closing bias torque acting through said spring support member not increasing from a closed position to a blown open position of said contact arm;

wherein said contact arms is positionable in a closed position and a blown open position, wherein said contact arms is closed when said at least two movable contacts are in contact with said first and second fixed contacts and said contact arm is blown open when said at least two movable contacts are repelled away from said first and second fixed contacts in response to a short circuit condition;

a first kinetic energy-absorbing stop disposed proximate to a first recess of said inner surface of said cassette, wherein a first surface of said contact arm, said first recess of said inner surface, and a surface of said first kinetic energy-absorbing stop are generally parallel to each other when said contact arm is in said blown open position; and a second kinetic energy-absorbing stop disposed proximate to a second recess of said inner surface of said cassette, wherein a second surface of said contact arm, said second recess of said inner surface, and a surface of said second kinetic energy-absorbing stop are generally parallel to each other when said contact arm is in said blown open position;

wherein said first and second kinetic energy-absorbing stops absorb and dissipate the kinetic energies resulting from magnetic repulsive forces forcing said at least two movable contacts and said first and second fixed contacts apart during a short circuit condition so that said contact arms does not rebound to the closed position.

11. The circuit breaker of claim 10, wherein:

said movable contact assembly further comprises a rotor rotably mounted within said housing;

said contact arm has a common pivot relative to said rotor.

12. The circuit breaker cassette of claim 1 wherein:

said at least one contact spring has a second orientation in a blown open position that exerts a second bias torque on said contact arm relative to said at least two fixed contacts biasing said contact arm in an open position.

* * * * *